US007393291B2

(12) United States Patent
Huang et al.

(10) Patent No.: US 7,393,291 B2
(45) Date of Patent: Jul. 1, 2008

(54) PITCHING PRACTICE APPARATUS

(76) Inventors: Wen-Chih Huang, 1F, No. 61, Lane 167, Tsu-Hsiu N. Rd., Chang-Hua City (TW); Jui-Yang Lin, 2F, No. 492-19, Sec. 1, Wan-Shou Rd., Kui-Shan Hsiang, Tao-Yuan Hsien (TW)

( * ) Notice: Subject to any disclaimer, the term of this patent is extended or adjusted under 35 U.S.C. 154(b) by 857 days.

(21) Appl. No.: 10/740,981

(22) Filed: Dec. 19, 2003

(65) Prior Publication Data

US 2005/0137035 A1 Jun. 23, 2005

(51) Int. Cl.
*A63B 69/00* (2006.01)

(52) U.S. Cl. ..... 473/456; 473/451; 473/454; 473/455

(58) Field of Classification Search ..... 473/421–422, 473/431, 434, 451, 454–456; 273/368, 404, 273/406; 434/11–19, 23, 247; 463/49, 50–57
See application file for complete search history.

(56) References Cited

U.S. PATENT DOCUMENTS 3,157,399 A * 11/1964 Gaudet ..... 473/455
4,629,188 A * 12/1986 Mahieu ..... 473/454
4,781,376 A * 11/1988 Barnes, Sr. ..... 473/455
5,046,729 A * 9/1991 Yancey ..... 473/455
5,230,505 A * 7/1993 Paquet et al. ..... 473/455
5,401,016 A * 3/1995 Heglund et al. ..... 473/476
5,509,649 A * 4/1996 Buhrkuhl ..... 473/455
5,566,934 A * 10/1996 Black et al. ..... 473/431
5,599,017 A * 2/1997 Bixler et al. ..... 473/436
5,602,638 A * 2/1997 Boulware ..... 356/28
5,820,496 A * 10/1998 Bergeron ..... 473/455
6,155,936 A * 12/2000 Dorr ..... 473/456
6,350,211 B1 * 2/2002 Kolmar ..... 473/454
6,837,495 B2 * 1/2005 Gerson et al. ..... 273/372
2002/0052255 A1 * 5/2002 Trevino ..... 473/455
2002/0081002 A1 * 6/2002 Lee et al. ..... 382/107

* cited by examiner

*Primary Examiner*—Corbett Coburn
*Assistant Examiner*—David W Duffy
(74) *Attorney, Agent, or Firm*—Muncy, Geissler, Olds & Lowe, PLLC

(57) ABSTRACT

A pitching practice apparatus includes a frame unit having a rectangular frame member, X-axis and Y-axis sensor units mounted on the frame member, a control unit connected to the sensor units and to a sound generating device, and a net body provided on the frame unit. The sensor units are operable so as to form sampling regions for sensing entry of a ball into the frame member. The control unit determines position of the ball entering into the frame member, and compares the ball position with preset parameters to determine whether the ball is a good ball or a foul ball. Ball information determined by the control unit is shown on a display device. The sound generating device is used to generate a sound output corresponding to status of the ball that was thrown into the frame member as determined by the control unit.

6 Claims, 6 Drawing Sheets

PITCHING PRACTICE APPARATUS

BACKGROUND OF THE INVENTION

1. Field of the Invention

The invention relates to a practice apparatus, more particularly to a pitching practice apparatus which permits setting of a strike zone and which is capable of indicating ball speed and generating sound effects.

2. Description of the Related Art

Pitching practice apparatus for developing throwing technique are known in the art. Examples of conventional pitching practice apparatus include those disclosed in U.S. Pat. Nos. 5,333,856 and 5,803,842.

In U.S. Pat. No. 5,333,856, there is disclosed a pitching practice apparatus that includes a main frame member and a backstop member supported by the main frame member. A strike zone member is attached to the backstop member and forms a pouch to collect balls that are thrown toward the strike zone member.

In U.S. Pat. No. 5,803,842, there is disclosed a collapsible pitcher's practice cage that includes a frame having pivotally coupled first and second frame portions movable to open and closed positions, and a foldable fabric enclosure coupled to the first and second frame portions and to be struck by balls thrown during practice.

The aforesaid conventional pitching practice apparatus are unsatisfactory since no means is provided for informing the pitcher as to the ball speed and as to whether or not a thrown ball fell within a strike zone.

SUMMARY OF THE INVENTION

Therefore, the object of the present invention is to provide a pitching practice apparatus which permits setting of a strike zone and which is capable of indicating ball speed and generating sound effects so as to overcome the aforesaid drawbacks of the prior art.

According to the present invention, a pitching practice apparatus comprises:

a frame unit including a rectangular frame member formed from a pair of upright frame parts and a pair of horizontal frame parts connected to the upright frame parts, and a pair of leg frames that extend rearwardly from opposite lateral sides of the frame member and that support the frame unit on the ground;

an X-axis sensor unit including a set of spaced apart transmitters and a set of spaced apart receivers mounted on the horizontal frame parts, adjacent ones of the transmitters of the X-axis sensor unit and adjacent ones of the receivers of the X-axis sensor unit being spaced apart by a clearance smaller than a predetermined ball diameter, the transmitters and the receivers of the X-axis sensor unit being operable so as to form a first sampling region for sensing entry of a ball into the frame member;

a Y-axis sensor unit including a set of spaced apart transmitters and a set of spaced apart receivers mounted on the upright frame parts, adjacent ones of the transmitters of the Y-axis sensor unit and adjacent ones of the receivers of the Y-axis sensor unit being spaced apart by a clearance smaller than the predetermined ball diameter, the transmitters and the receivers of the Y-axis sensor unit being operable so as to form a second sampling region for sensing entry of the ball into the frame member, the second sampling region forming a distance with the first sampling region;

a sound generating device disposed externally of the frame unit and including a speaker;

a control unit connected electrically to the transmitters and the receivers of the X-axis and Y-axis sensor units, and the speaker of the sound generating device, the control unit including a controller mounted on the frame member, and a display device connected electrically to the controller;

the controller being configured with sampling parameters for controlling positions of the first and second sampling regions formed by the X-axis and Y-axis sensor units, and speech data to be reproduced by the speaker;

the controller referring to outputs of the X-axis and Y-axis sensor units so as to determine position of the ball entering into the frame member, and comparing the ball position with the sampling parameters to determine whether the ball is a good ball or a foul ball;

the controller further controlling the display device so as to show ball information determined by the controller on the display device, and further enabling the speaker to generate a sound output corresponding to status of the ball that was thrown into the frame member as determined by the controller; and a ball blocking device including a net body disposed rearwardly of the frame member and disposed to enclose the leg frames.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
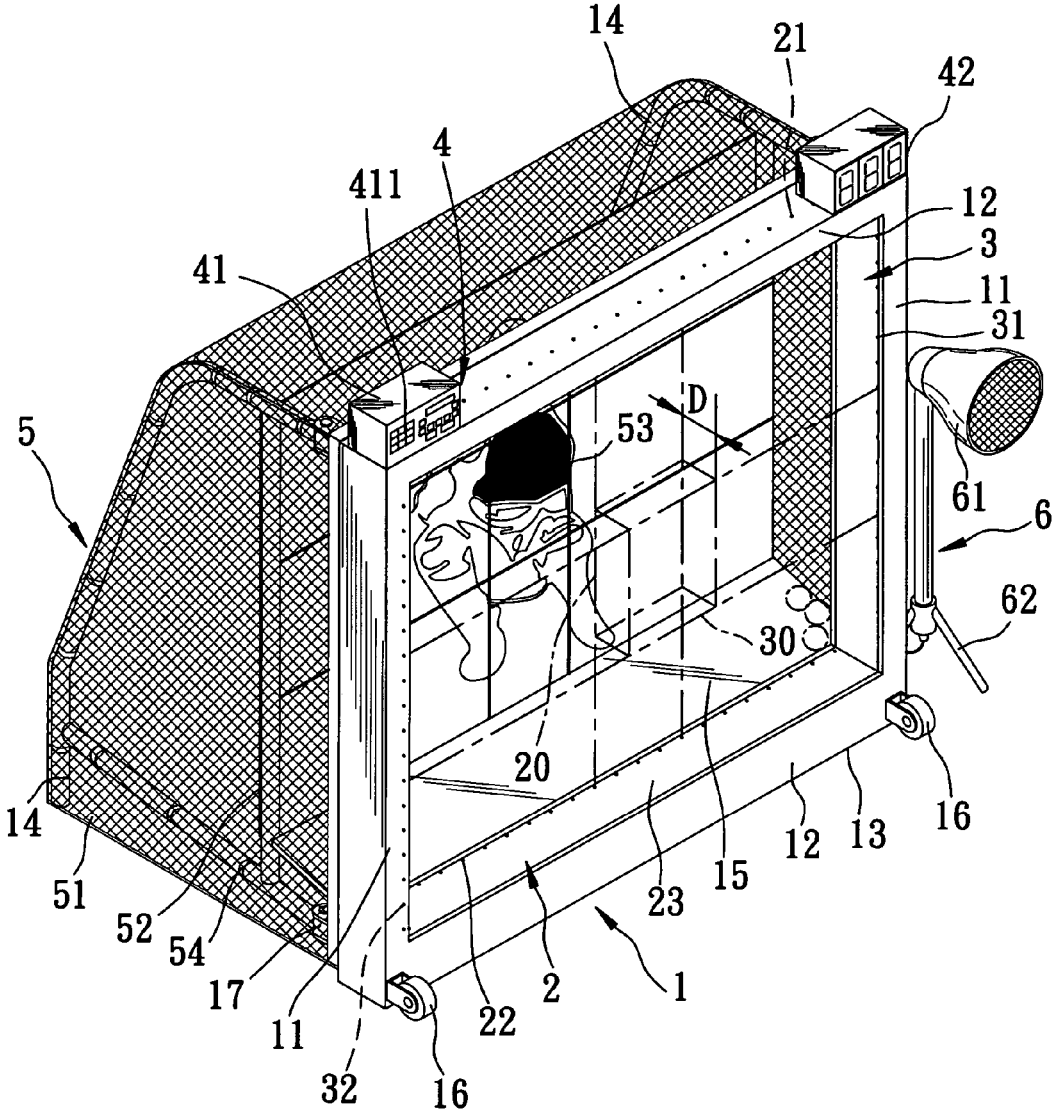
FIG. 1 is an assembled perspective view of the preferred embodiment of a pitching practice apparatus according to the present invention.
Figure 2:
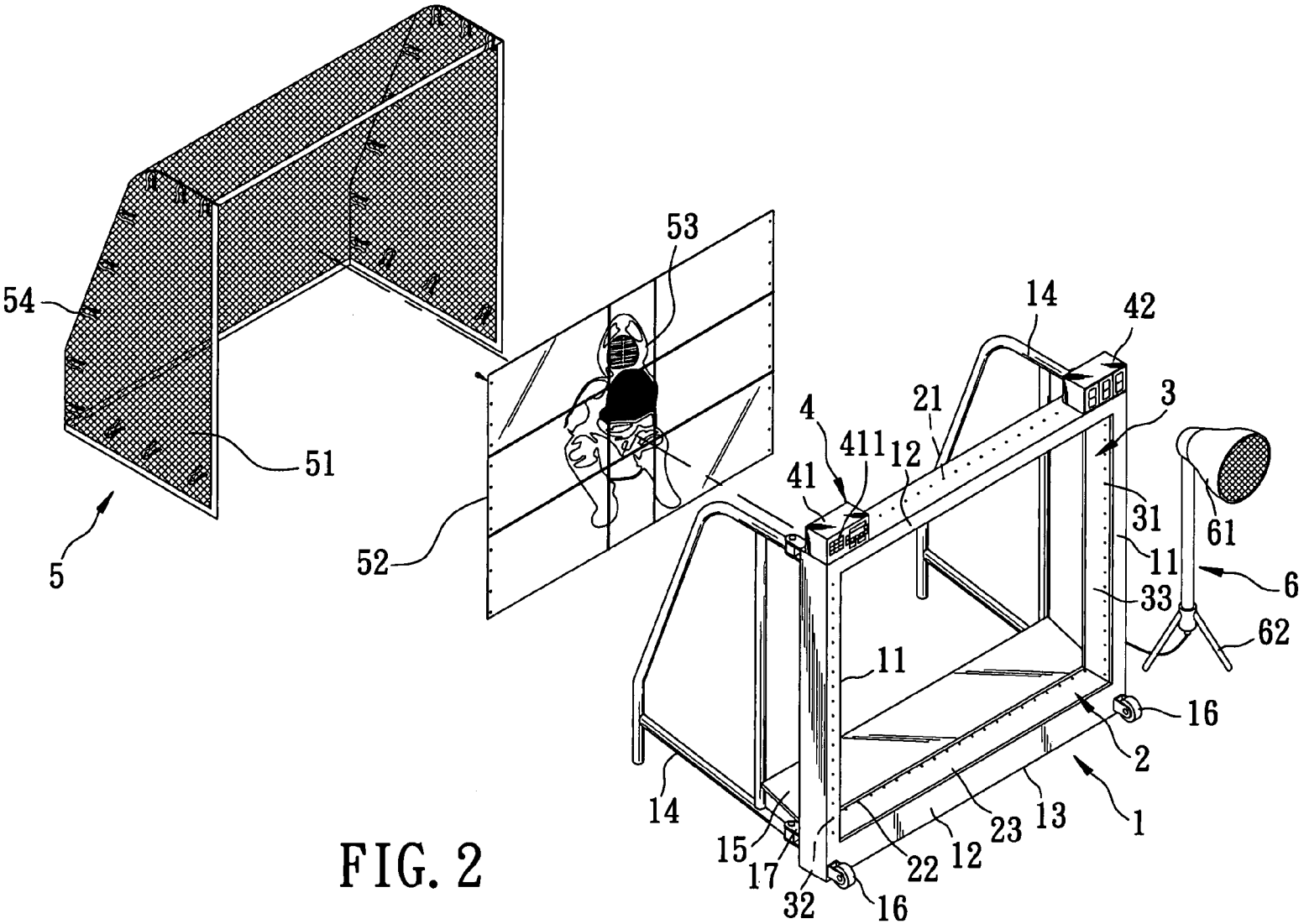
FIG. 2 is an exploded perspective view of the preferred embodiment.

Referring to FIGS. 1 and 2, the preferred embodiment of a pitching practice apparatus according to the present invention is shown to comprise a frame unit 1, an X-axis sensor unit 2, a Y-axis sensor unit 3, a control unit 4, a ball blocking device 5, and a sound generating device 6.

The frame unit 1 includes a rectangular frame member 13 formed from a pair of upright frame parts 11 and a pair of horizontal frame parts 12 connected to the upright frame parts 11. The frame unit 1 further includes a pair of leg frames 14 that extend rearwardly from opposite lateral sides of the frame member 13 and that support the frame unit 1 on the ground. A ball collecting plate 15 has a width equal to that of the horizontal frame parts 12, and is disposed inclinedly and adjacent to bottom portions of the leg frames 14 and the frame member 13. A pair of wheel members 16 are mounted on opposite end portions of a lower one of the horizontal frame parts 12.

Figure 4:
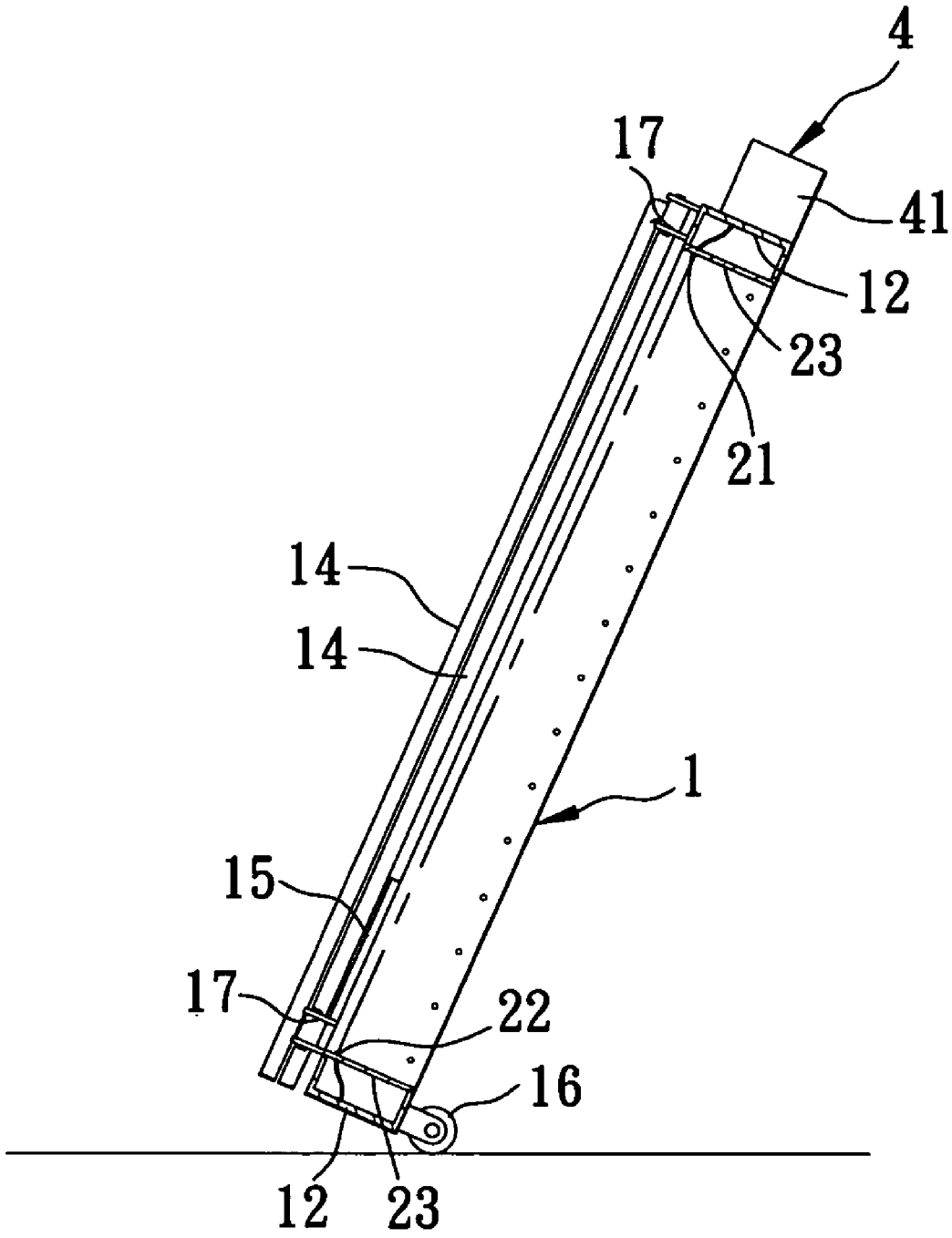
FIG. 4 is a schematic partly sectional view of the preferred embodiment.

Referring to FIGS. 1, 2 and 4, the X-axis sensor unit 2 includes a set of spaced apart transmitters 21 and a set of spaced apart receivers 22 mounted respectively on the horizontal frame parts 12. The transmitters 21 and receivers 22 are connected electrically to the control unit 4. Adjacent ones of the transmitters 21 and adjacent ones of the receivers 22 are spaced apart by a clearance smaller than a predetermined ball diameter. The transmitters 21 and receivers 22 are operable so as to form a first sampling region 20 for sensing entry of a ball into the frame member 13. The X-axis sensor unit 2 further includes a pair of circuit boards 23 (see FIG. 4) associated with a respective one of the set of transmitters 21 and the set of receivers 22 and mounted on the horizontal frame parts 12, respectively. In this embodiment, the transmitters 21 include light emitting diodes provided on an upper one of the horizontal frame parts 12, and the receivers 22 include receiving diodes provided on a lower one of the horizontal frame parts 12.

The Y-axis sensor unit 3 includes a set of spaced apart transmitters 31 and a set of spaced apart receivers 32 mounted respectively on the upright frame parts 11. The transmitters 31 and receivers 32 are connected electrically to the control unit 4. Adjacent ones of the transmitters 31 and adjacent ones of the receivers 32 are spaced apart by a clearance smaller than the predetermined ball diameter. The transmitters 31 and receivers 32 are operable so as to form a second sampling region 30. In this embodiment, the second sampling region 30 is disposed in front of the first sampling region 20, and forms a distance (D) with the first sampling region 20. The Y-axis sensor unit 3 further includes a pair of circuit boards 33 (only one is visible in the drawings) associated with a respective one of the set of transmitters 31 and the set of receivers 32 and mounted on the upright frame parts 11, respectively. In this embodiment, the transmitters 31 include light emitting diodes provided on one of the upright frame parts 11, and the receivers 32 include receiving diodes provided on the other one of the upright frame parts 11.

The sound generating device 6 is disposed externally of the frame unit 1, and includes a speaker 61 connected electrically to and controlled by the control unit 4, and a stand 62 for supporting the speaker 61.

The control unit 4 includes a controller 41 mounted on the frame member 13, and a display device 42 connected electrically to the controller 41. The controller 41 is configured with sampling parameters for controlling positions of the first and second sampling regions 20, 30 formed by the X-axis and Y-axis sensor units 2, 3, and speech data to be reproduced by the speaker 61.

The ball blocking device 5 includes a net body 51 disposed rearwardly of the frame member 13 and disposed to enclose the leg frames 14. In this embodiment, a sponge protective layer 52 is disposed rearwardly of the frame member 13, and is disposed uprightly between and is secured to the leg frames 14. A human target 53 is formed on a front side of the sponge protective layer 52. The net body 51 is formed with a plurality of hook-and-loop fasteners 54 for securing the net body 51 onto the leg frames 14.

Figure 3:
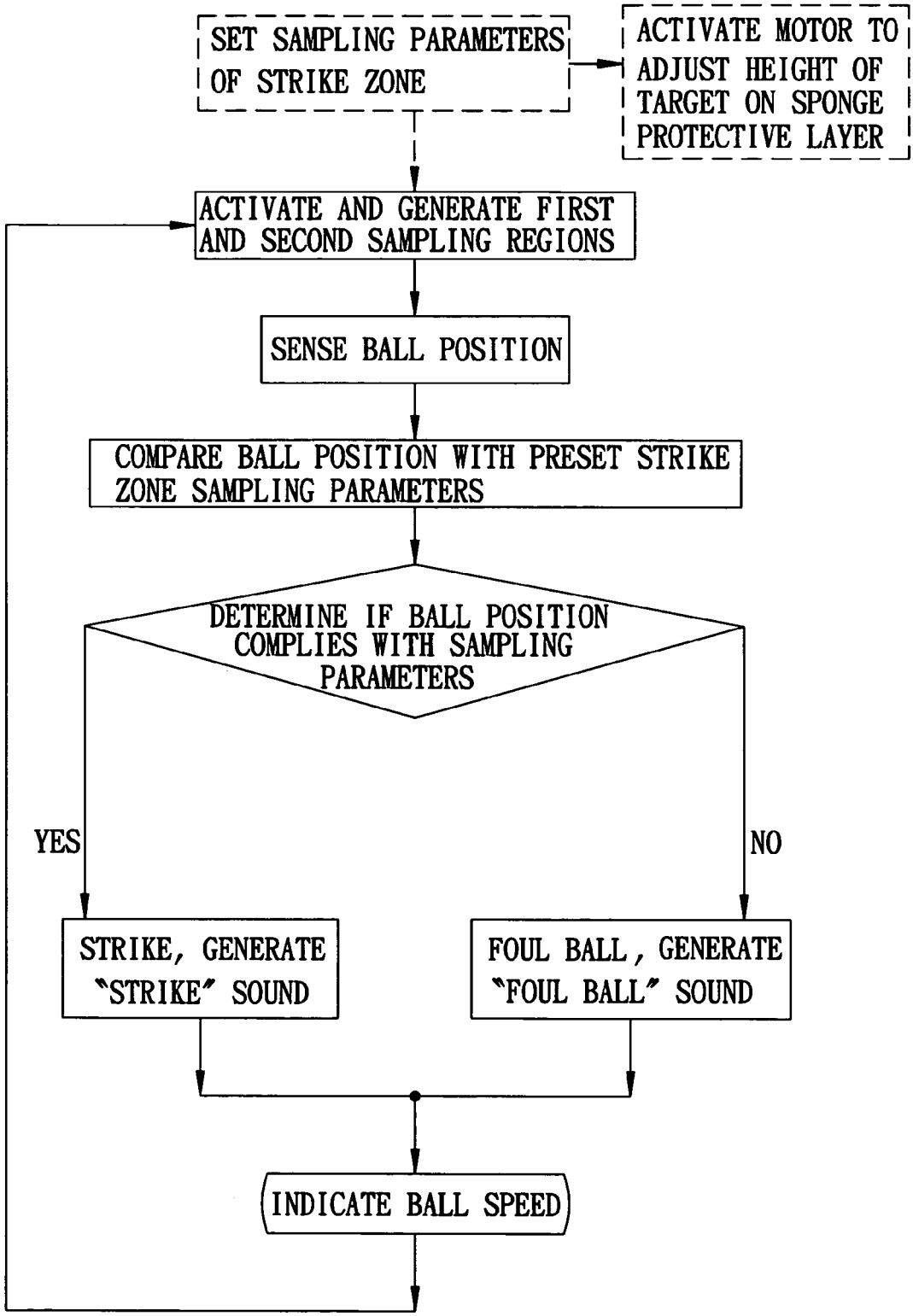
FIG. 3 is a flowchart to illustrate operation of a control unit of the preferred embodiment.

Referring once again to FIGS. 1 and 2, when a ball (not shown) is thrown into the frame member 13, the ball should first pass through the second sampling region 30 and subsequently through the first sampling region 20 before striking the sponge protective layer 52. The ball will then either bounce out or will be collected by the ball collecting plate 15. With further reference to FIG. 3, under normal conditions, the transmitters 21, 31 and the receivers 22, 32 of the X-axis and Y-axis sensor units 2, 3 are maintained in transmitting and receiving states, respectively. Therefore, a continuous electrical signal will be present at the outputs of the receivers 22, 32. When the ball passes through the first and second sampling regions 20, 30, the electrical signal from some of the receivers 22, 32 will be interrupted. In this way, the controller 41 will be able to determine the position of the ball entering into the frame member 13 and to compare the ball position with the preset sampling parameters. Upon determining that the ball position complies with the sampling parameters, i.e. the ball fell within a preset strike zone, the controller 41 will generate an output signal to enable the sound generating device 6. In response to the output signal, the speaker 61 will reproduce pre-recorded speech data, such as "strike," thereby indicating that the thrown ball is a good ball. When three consecutive good balls are thrown, another pre-recorded speech data, such as "safe," will be reproduced. In addition, by measuring the time that took for the ball to travel the distance (D) from the second sampling region 30 to the first sampling region 20, the controller 41 can then calculate the velocity or speed of the ball and control the display device 42 to show the calculated ball speed thereon so as to inform the pitcher. Accordingly, when the ball did not fall within the strike zone, the controller 41 will activate the sound generating device 6 to reproduce yet another pre-recorded speech data, such as "foul," thereby indicating that the thrown ball is a foul ball. When three consecutive foul balls are thrown, still another pre-recorded speech data, such as "out," will be reproduced.

Figure 5:
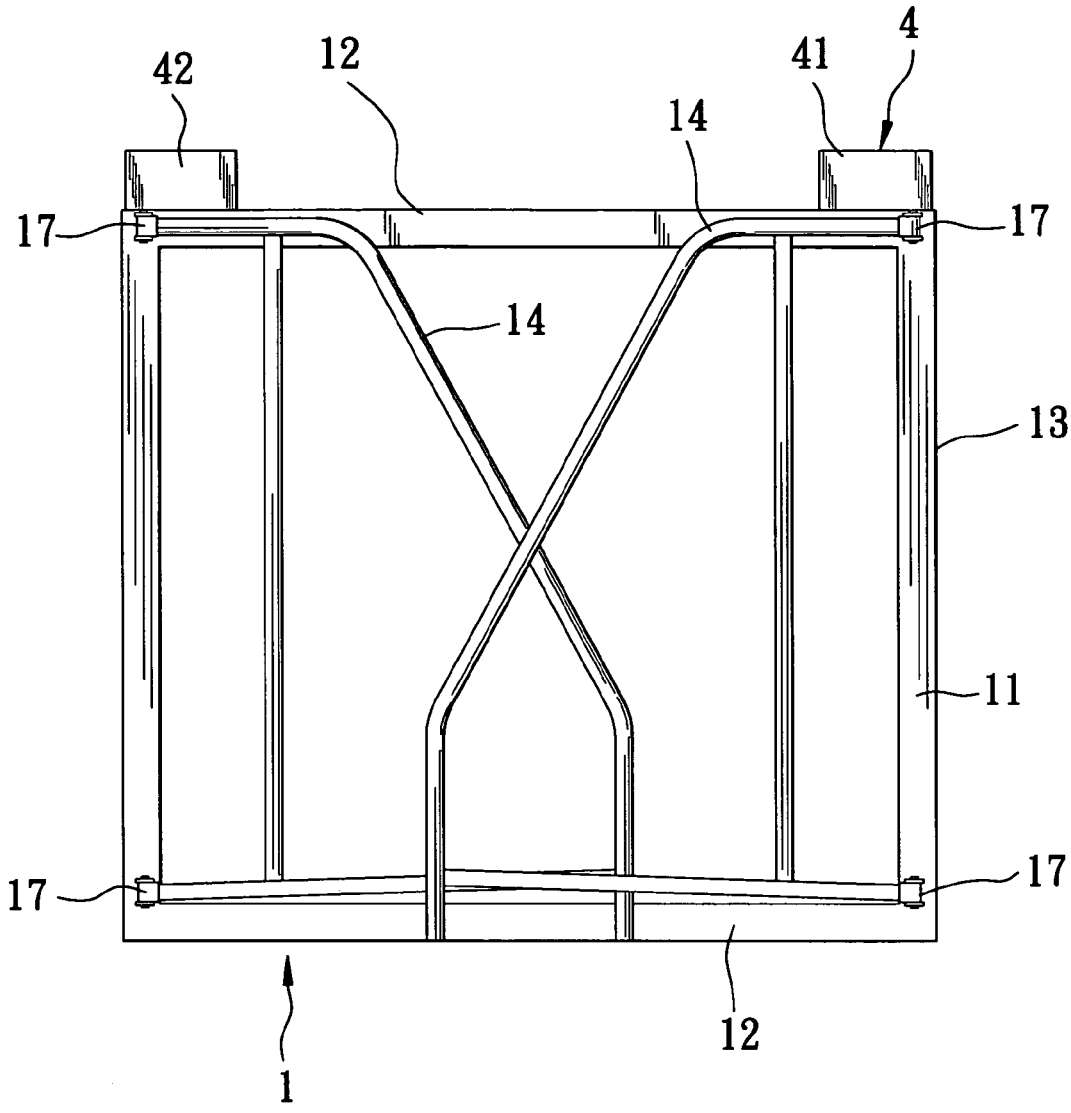
FIG. 5 is a rear plan view illustrating a frame unit of the preferred embodiment in a collapsed state.

Referring to FIGS. 4 and 5, when the pitching practice apparatus of this invention is not in use, due to pivot joints 17 which connect the leg frames 14 to the frame member 13, the leg frames 14 can be folded onto the rear side of the frame member 13, thereby reducing the size of the apparatus and the storage space required thereby. Moreover, because of the presence of the wheel members 16, the pitching practice apparatus of this invention can be easily and conveniently moved from one place to another after the frame unit 1 has been collapsed.

When the pitching practice apparatus of this invention is used by a beginner, the human target 53 on the sponge protective layer 52 can serve to guide the pitcher to throw the ball into the strike zone.

Figure 6:
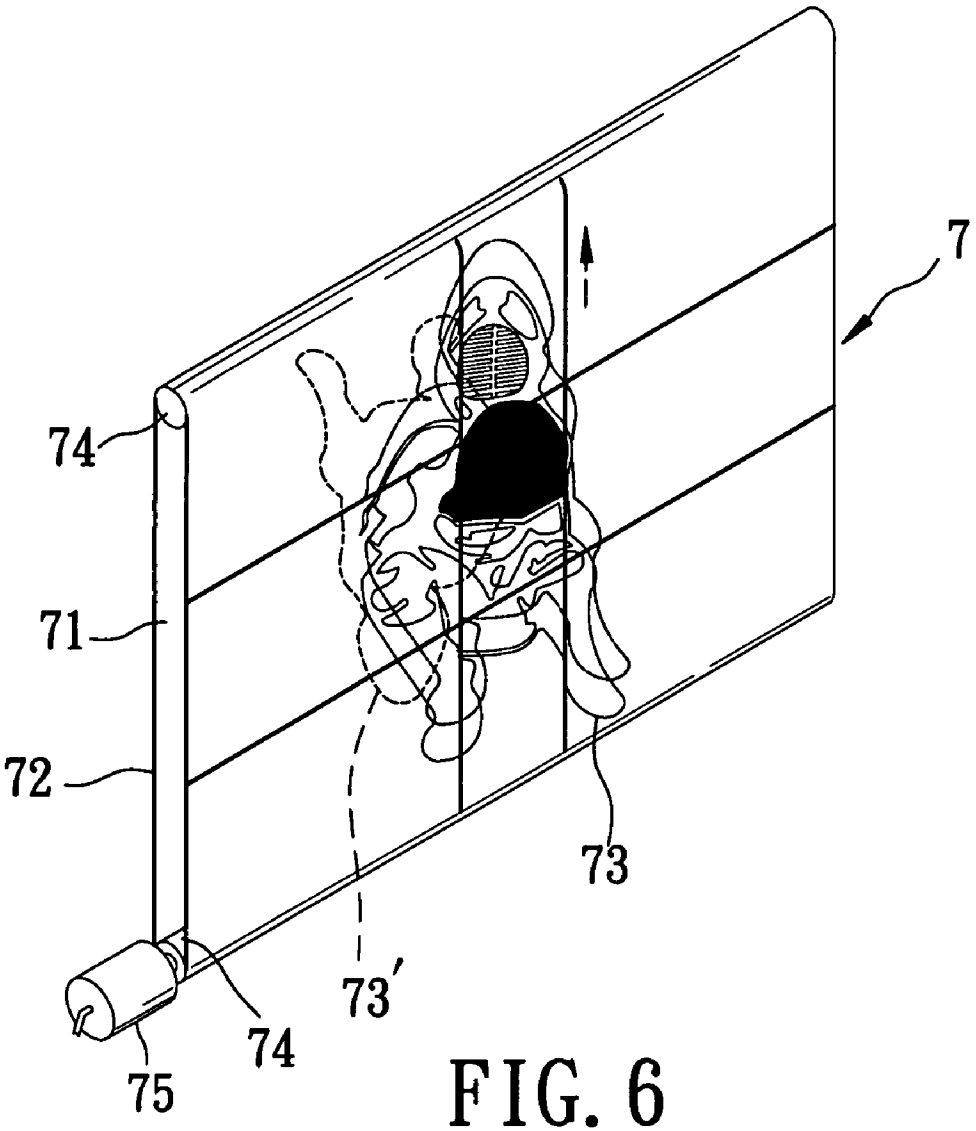
FIG. 6 is a perspective view illustrating a modified sponge protective layer of a ball blocking device of the pitching practice apparatus of the preferred embodiment.

The fixed sponge protective layer 52 of the ball blocking device 5 shown in FIG. 1 can be modified into an adjustable sponge protective layer 7, as shown in FIG. 6. The adjustable sponge protective layer 7 includes a protective body 72 formed into a loop and having an inner surface that confines a receiving space 71. A human target 73 is formed on a front side of the protective body 72. Two horizontally extending axles 74 are disposed in the receiving space 71 at positions corresponding to the horizontal frame parts 12, and engage the inner surface of the protective body 72. A motor 75 is coupled to one of the axles 74 and is connected electrically to the controller 41.

Referring to FIGS. 1, 3 and 6, by operating setting keys 411 on the controller 41, the user can configure a desired strike zone to suit his height. The controller 41 then activates the motor 75 automatically so as to rotate the protective body 72 via the axles 74 in order to adjust the height of the human target 73 according to the strike zone position defined by the first and second sampling regions 20, 30.

Preferably, one side of the protective body 72 is formed with a larger human target 73 to suit adults playing with the apparatus, whereas an opposite side of the protective body 72 is formed with a smaller human target 73' to suit children playing with the pitching practice apparatus of this invention.

The following are some of the advantages of the pitching practice apparatus of this invention:

1. The control unit 4 cooperates with the X-axis and Y-axis sensor units 2, 3 to generate first and second sampling regions 20, 30, and can calculate a strike zone based on input parameters.

2. Due to the sound generating device 6 and the display device 42, the pitcher is able to determine the ball speed, as well as whether a ball that was thrown is a good ball or a foul ball.

3. The human target 53, 73, 73' can serve as a guide for the pitcher. In addition, the height of the human target 73, 73' can be adjusted by the motor 75 according to the input parameters to suit the height of the pitcher.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A pitching practice apparatus comprising:

a frame unit including a rectangular frame member formed from a pair of upright frame parts and a pair of horizontal frame parts connected to said upright frame parts, and a pair of leg frames that are collapsible and extend rearwardly from opposite lateral sides of said frame member and that support said frame unit on the ground;

an X-axis sensor unit including a set of spaced apart transmitters and a set of spaced apart receivers mounted on said horizontal frame parts, adjacent ones of said transmitters of said X-axis sensor unit and adjacent ones of said receivers of said X-axis sensor unit being spaced apart by a clearance smaller than a predetermined ball diameter, said transmitters and said receivers of said X-axis sensor unit being operable so as to form a first sampling region for sensing entry of a ball into said frame member;

a Y-axis sensor unit including a set of spaced apart transmitters and a set of spaced apart receivers mounted on said upright frame parts, adjacent ones of said transmitters of said Y-axis sensor unit and adjacent ones of said receivers of said Y-axis sensor unit being spaced apart by a clearance smaller than the predetermined ball diameter, said transmitters and said receivers of said Y-axis sensor unit being operable so as to form a second sampling region for sensing entry of the ball into said frame member, said second sampling region forming a distance with said first sampling region;

a sound generating device disposed externally of said frame unit and including a speaker;

a control unit connected electrically to said transmitters and said receivers of said X-axis and Y-axis sensor units, and said speaker of said sound generating device, said control unit including a controller mounted on said frame member, and a display device connected electrically to said controller;

said controller being configured with sampling parameters for controlling positions of said first and second sampling regions formed by said X-axis and Y-axis sensor units, and speech data to be reproduced by said speaker;

said controller referring to outputs of said X-axis and Y-axis sensor units so as to determine position of the ball entering into said frame member, and comparing the ball position with the sampling parameters to determine whether the ball is a good ball or a foul ball;

said controller further controlling said display device so as to show ball information determined by said controller on said display device, and further enabling said speaker to generate a sound output corresponding to status of the ball that was thrown into said frame member as determined by said controller; and a ball blocking device including a net body disposed rearwardly of said frame member and disposed to enclose said leg frames; and a sponge protective layer disposed rearwardly of said frame member and disposed uprightly between and secured to said leg frames, said sponge protective layer including:

a protective body formed into a loop and having an inner surface that confines a receiving space, said protective body having opposite sides, at least one of which is formed with a human target;

a pair of horizontally extending axles disposed in said receiving space at positions corresponding to said horizontal frame parts, said axles engaging said inner surface of said protective body; and a motor coupled to one of said axles and connected electrically to said controller;

wherein said controller is electrically connected to said motor and controls said motor to rotate said protective body via said axles in order to adjust the height of said human target according to the positions of said first and second sampling regions.

2. The pitching practice apparatus as claimed in claim 1, wherein said ball blocking device further includes a plurality of hook-and-loop fasteners formed on said net body for securing said net body onto said leg frames.

3. The pitching practice apparatus as claimed in claim 1, wherein said frame unit further includes a ball collecting plate having a width equal to that of said horizontal frame parts, said ball collecting plate being disposed inclinedly and adjacent to bottom portions of said leg frames and said frame member.

4. The pitching practice apparatus as claimed in claim 1, wherein said frame unit further includes a pair of wheel members mounted on opposite end portions of a lower one of said horizontal frame parts.

5. The pitching practice apparatus as claimed in claim 1, wherein said frame unit further includes pivot joints for connecting pivotally said leg frames to said frame member.

6. The pitching practice apparatus as claimed in claim 1, wherein said sound generating device further includes a stand for supporting said speaker.

* * * * *